US005584340A

United States Patent [19]

Derosier

[11] Patent Number: 5,584,340

[45] Date of Patent: Dec. 17, 1996

[54] HEAT EXCHANGER WITH FLEXIBLE TUBE SUPPORT

[75] Inventor: Gregory S. Derosier, Conyers, Ga.

[73] Assignee: Heatcraft Inc., Grenada, Miss.

[21] Appl. No.: 512,230

[22] Filed: Aug. 7, 1995

[51] Int. Cl.[6] ..... F28F 7/00

[52] U.S. Cl. ..... 165/82; 165/149; 165/DIG. 66

[58] Field of Search ..... 165/82, 149, 150, 165/81

[56] References Cited

U.S. PATENT DOCUMENTS

| | | | |
|---|---|---|---|
| 1,809,910 | 6/1931 | Price . | |
| 1,868,661 | 7/1932 | Heimberger . | |
| 1,890,186 | 12/1932 | Lucke . | |
| 1,894,279 | 1/1933 | Meyer . | |
| 1,990,251 | 2/1935 | Potter . | |
| 2,072,975 | 3/1937 | Winsborough et al. | 165/82 |
| 2,278,086 | 3/1942 | Lea . | |
| 2,357,156 | 8/1944 | Wilson | 165/81 |
| 2,413,360 | 12/1946 | Maguire et al. | 165/81 |
| 2,612,350 | 9/1952 | Stadler . | |
| 3,494,414 | 2/1970 | Warner . | |
| 5,020,587 | 6/1991 | Mongia et al. | 165/82 |
| 5,158,134 | 10/1992 | Mongia et al. . | |

FOREIGN PATENT DOCUMENTS

| | | |
|---|---|---|
| 0080742A2 | 6/1983 | European Pat. Off. . |
| 0152967A1 | 8/1985 | European Pat. Off. . |
| 3502116A1 | 7/1986 | Germany . |

*Primary Examiner*—Leonard R. Leo
*Attorney, Agent, or Firm*—W. Kirk McCord

[57] ABSTRACT

A heat exchanger coil is comprised of plural metal tubes of generally circular cross-section, plural heat transfer enhancing fins and plural relatively flat metal support plates, each of which has plural first holes and plural second holes arranged in parallel rows. The tubes are laced through the respective holes in the plates and through aligned holes in the fins such that the tubes extend generally at right angles to the respective planes of the plates and fins. In one embodiment, each plate is cut to define two discrete flexible sections and a resilient arm for flexibly coupling one of the two sections of each plate with a relatively fixed portion of the corresponding plate. The first holes, which are oversized relative to the outside diameter of the tubes laced therethrough, are formed in both the relatively fixed portion and the two flexible sections of each plate. The second holes, which are smaller in diameter than the first holes, are formed only in the two flexible sections of each plate. The tubes extending through the second holes are in contact with the corresponding flexible sections such that the flexible sections provide support for all of the tubes and fins of the heat exchanger coil. The tubes extending through the first holes are able to float with respect to the plates because of the oversized first holes, while the tubes extending through the second holes are constrained to move relative to the plates along with the corresponding flexible sections.

28 Claims, 7 Drawing Sheets

HEAT EXCHANGER WITH FLEXIBLE TUBE SUPPORT

FIELD OF INVENTION

This invention relates generally to heat exchangers used in refrigeration and air conditioning applications and in particular to a heat exchanger having flexible support for heat transfer fluid carrying tubes.

BACKGROUND ART

Heat exchangers (e.g., evaporators and condensers) typically undergo dimensional changes due in large part to thermal expansion/contraction. Because different parts of the heat exchanger may expand and/or contract at different rates, parts of the heat exchanger may be subjected to relatively high mechanical stresses leading to premature failure. This problem is even more pronounced in relatively large heat exchangers used, for example, in commercial refrigeration applications.

Typically, heat exchangers used in refrigeration and air conditioning applications include plural heat transfer fluid carrying tubes and at least two support plates having plural holes through which the respective tubes extend. Such heat exchangers also typically include plural fins for enhancing heat transfer between the fluid in the tubes (e.g., a vapor compression refrigerant) and an external fluid passing through the heat exchanger (e.g., air to be cooled in the case of an evaporator). As the fins expand and contract due to temperature changes, the tubes are pressed against the support plates, which can lead to tube damage and failure. The greater the length of the fins the greater will be the effects of the thermal expansion and contraction.

It is known in the art to relieve mechanical stresses by allowing the tubes to "float". For example, a heat exchanger may be equipped with a fixed support plate and a floating support plate. Thermal expansion and contraction are accommodated by movement of the floating support plate. Another approach involves allowing the tubes to float relative to one of the support plates. However, in both of these approaches, only one end of each tube is able to move, while the other end is relatively fixed.

Still another approach, as shown in U.S. Pat. Nos. 5,020,587, and 5,158,134, is to provide support plates with oversized holes to allow the tubes to float relative to the support plates. A second set of tubes (which do not carry heat transfer fluid) is rigidly connected to the support plates and the support tubes are connected to the heat transfer fluid carrying tubes by the fins. Although each tube is able to float at both ends thereof relative to the support plates, the additional tubes that are required for support result in increased weight and expense.

There is therefore a need for an improved heat exchanger with flexible tube support to accommodate thermal expansion and contraction of the heat exchanger components.

DISCLOSURE OF INVENTION

In accordance with the present invention, a heat exchanger with flexible tube support is comprised of first and second tubes interconnected to accommodate passage of a heat transfer fluid therethrough; spaced apart first and second support members having respective first and second holes therein; and third and fourth support members coupled with the respective first and second support members such that the third and fourth support members are movable relative to the first and second support members. The first tube extends between the first and second support members and penetrates through the first and second holes. The third and fourth support members have respective third and fourth holes therein. The second tube extends between the third and fourth support members and penetrates through the third and fourth holes.

In accordance with a feature of the invention, the first and second holes are sized to allow the first tube to move relative to the first and second support members, while the third and fourth holes are sized to substantially inhibit movement of the second tube relative to the third and fourth support members and to maintain the second tube substantially in contact with the third and fourth support members, whereby the first and second tubes are supported. The second tube is movable with the third and fourth support members relative to the first and second support members.

In accordance with another feature of the invention, the heat exchanger includes a third tube interconnected with the first and second tubes and fifth and sixth support members coupled with the respective first and second support members such that the fifth and sixth support members are movable relative to the respective first and second support members. The fifth and sixth support members have respective fifth and sixth holes therein. The third tube extends between the fifth and sixth support members and penetrates through the fifth and sixth holes.

In accordance with yet another feature of the invention, the fifth and sixth holes are sized to substantially inhibit movement of the third tube relative to the fifth and sixth support members and to maintain the third tube substantially in contact with the fifth and sixth support members. The third tube is movable with the fifth and sixth support members relative to the first and second support members. The fifth and sixth support members are cooperative with the third and fourth support members to support the first, second and third tubes and to accommodate movement of the second and third tubes relative to the first and second support members.

In accordance with one embodiment of the invention, the third support member is comprised of a first section of the first support member and is defined by a plurality of first cut lines in the first support member; the fourth support member is comprised of a first section of the second support member and is defined by a plurality of first cut lines in the second support member; the fifth support member is comprised of a second section of the first support member and is defined by a plurality of second cut lines in the first support member; and the sixth support member is comprised of a second section of the second support member and is defined by a plurality of second cut lines in the second support member. The respective first sections of the first and second support members are generally rectangular and the respective second sections thereof are each defined by three cut lines interconnected to define three sides of a rectangle.

The first support member has additional cut lines extending generally at right angles from the first section thereof to define a first resilient arm for supporting the corresponding first section and for accommodating movement of the corresponding first section relative to a remaining, relatively fixed section of the first support member. The second support member also has additional cut lines extending generally at right angles from the first section thereof to define a second resilient arm for supporting the corresponding first section and for accommodating movement of the corresponding first section relative to a remaining, relatively fixed section of the second support member. The first and second resilient arms enable the respective first sections of the first and second support members to move with the second tube along a longitudinal axis of the second tube and also along an axis parallel to respective major surfaces of the first and second support members, which are preferably relatively flat plates. However, the respective second sections of the first and second support members are substantially movable with the third tube only along a longitudinal axis of the third tube.

In accordance with the present invention, flexible support is provided for the heat transfer fluid carrying tubes of a heat exchanger to accommodate movement of the tubes caused by thermal expansion and contraction of the heat exchanger components. The oversized first and second holes allow the tubes extending therethrough to float with respect to the first and second support members. By way of contrast, the relatively smaller third, fourth, fifth and sixth holes maintain the tubes extending therethrough in contact with the corresponding flexible third, fourth, fifth and sixth support members to provide support for all of the heat exchanger tubes, while allowing the tubes extending through the relatively smaller holes to move along with the flexible support members with respect to the relatively fixed first and second support members.

BEST MODE FOR CARRYING OUT THE INVENTION

The best mode for carrying out the invention will now be described with reference to the accompanying drawings. Like parts are marked with the same respective reference numbers throughout the specification and drawings. The drawings are not necessarily to scale and in some instances proportions may have been exaggerated in order to more clearly depict certain features of the invention.

Figure 1:
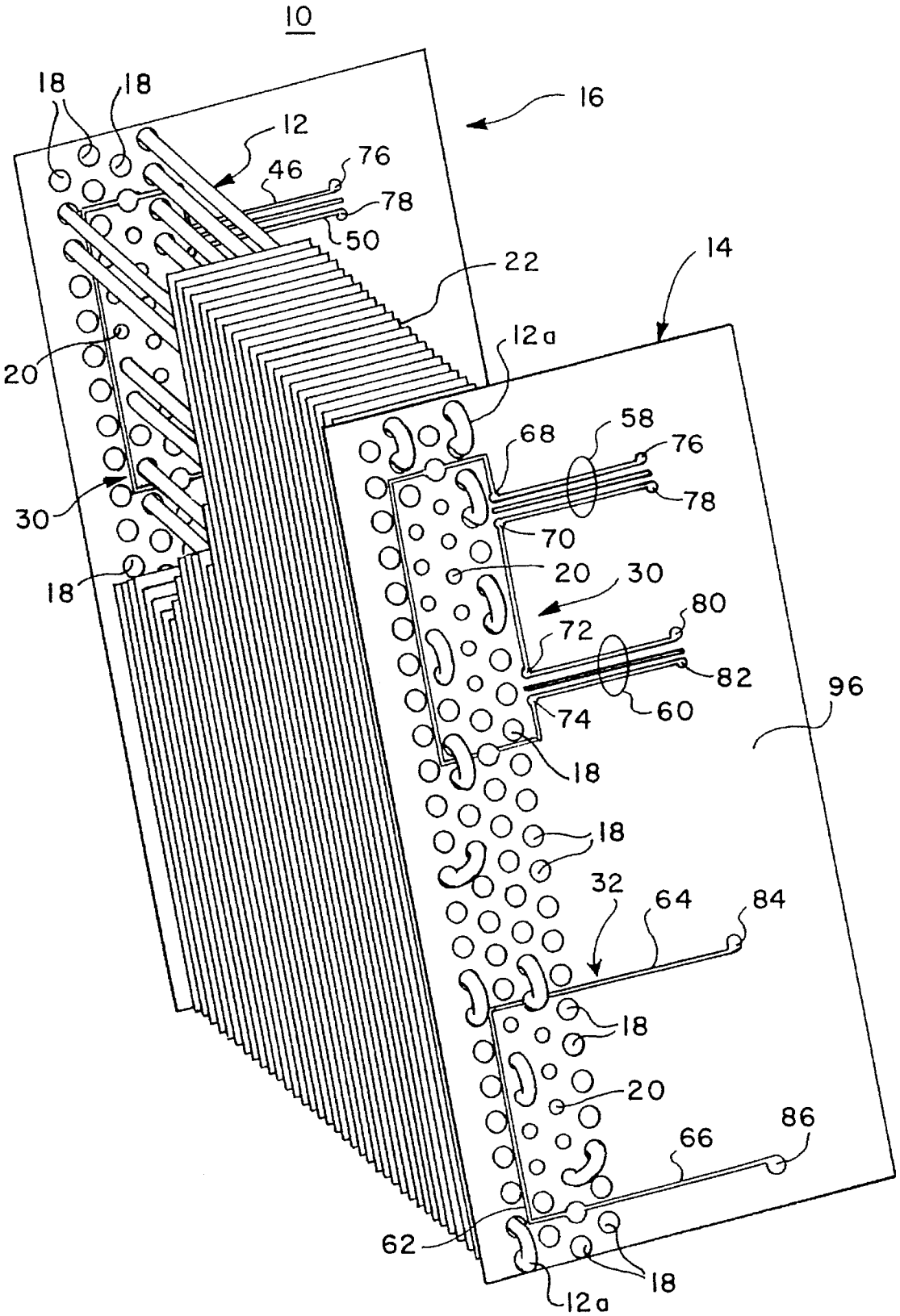
FIG. 1 is a perspective view of a heat exchanger with flexible tube support, according to the present invention.
Figure 2:
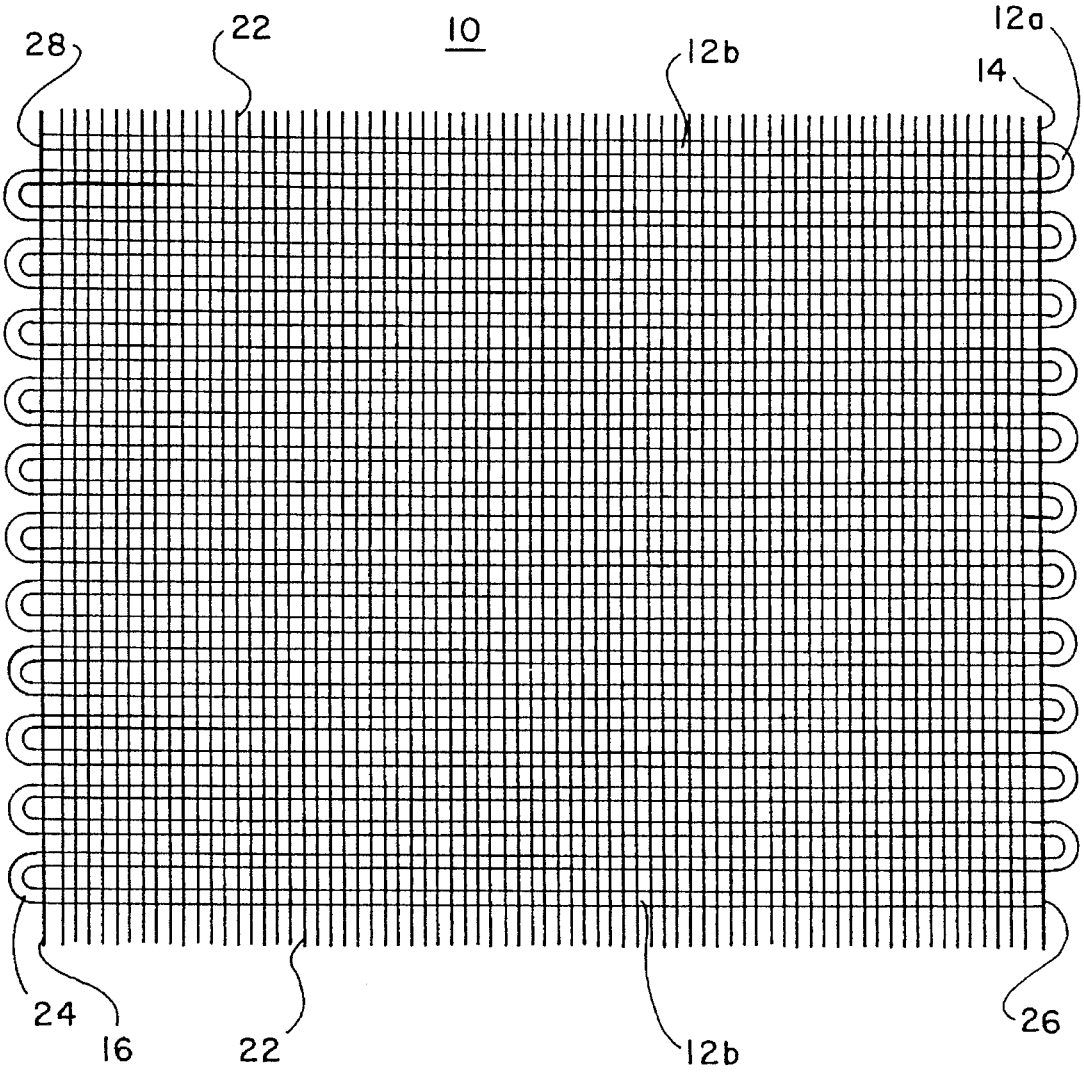
FIG. 2 is an elevation view of the heat exchanger of FIG. 1.
Figure 3:
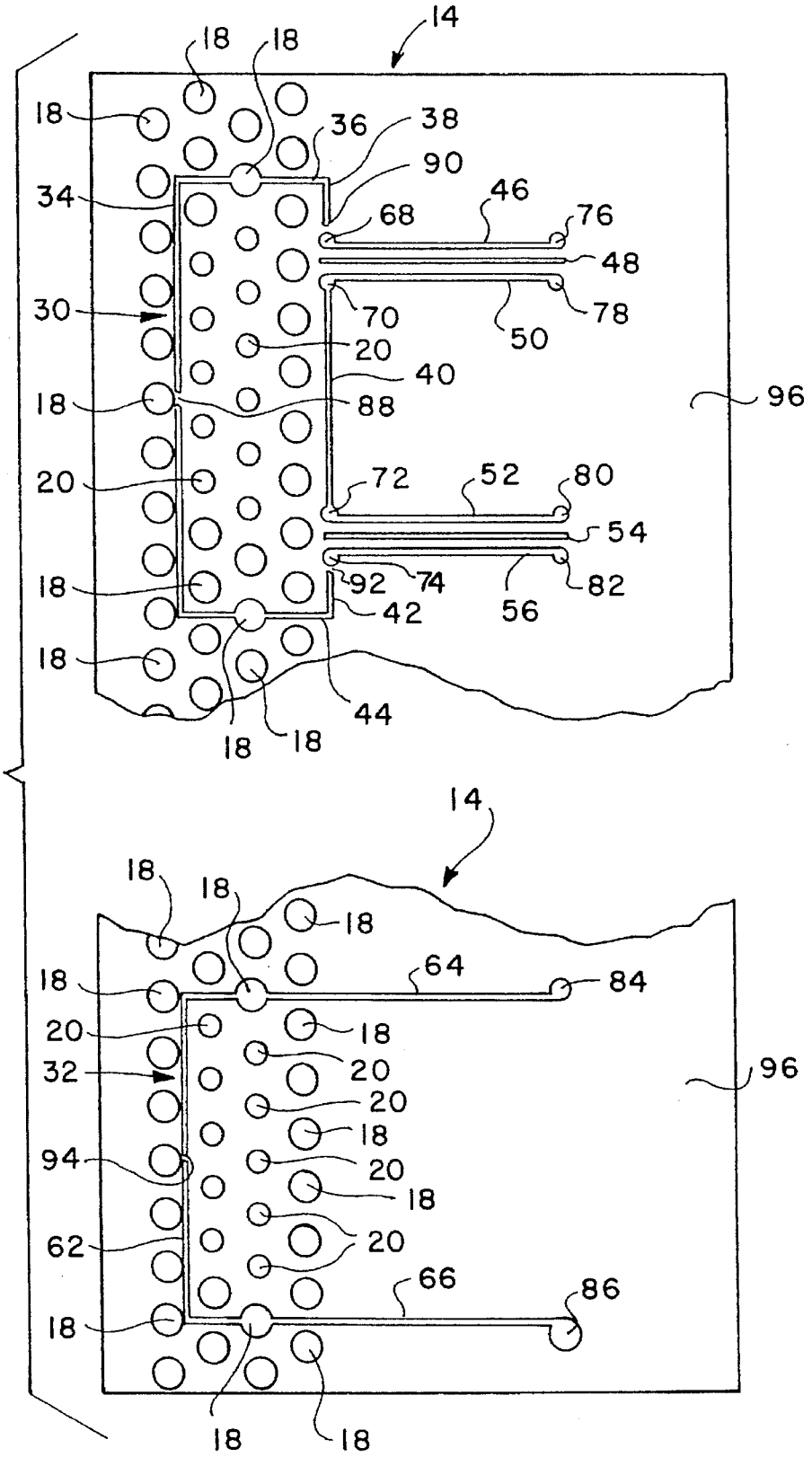
FIG. 3 is a detailed view of a flexible tube support of the heat exchanger of FIG. 1.

Referring to FIGS. 1–3, a heat exchanger coil 10 is comprised, at least in part, of plural metal (e.g., copper) tubes 12 of generally circular cross-section, each of which is bent in a conventional U-shaped hairpin configuration, and spaced apart, parallel support plates 14 and 16, made of metal (e.g., galvanized steel or aluminum). Each support plate 14, 16 is relatively flat and has plural first holes 18 and plural second holes 20 arranged in parallel rows. Four such rows of holes 18, 20 are shown on each plate 14, 16 in FIGS. 1 and 3 for illustration purposes only. One skilled in the art will recognize that the number of rows of holes 18, 20 is a matter of design choice. Each hole 18, 20 is generally circular. Plates 14 and 16 are fastened to a cabinet structure (not shown), which is also typically made of metal such as galvanized steel or aluminum.

As can be best seen in FIG. 2, each tube 12 has a hairpin end **12*a* and two straight leg portions 12*b* terminating at distal ends. Straight leg portions 12*b* are laced through respective holes 18, 20 in plates 14 and 16 and through aligned holes (not shown) in plural heat transfer enhancing fins 22, such that tubes 12 extend generally at right angles to respective major surfaces of plates 14 and 16 and fins 22. Fins 22 are typically made of relatively thin strips of aluminum. The distal ends of successive tubes 12 are interconnected by conventional U-shaped return bends 24 (FIG. 2), such that tubes 12 define a plurality of discrete circuits, to accommodate passage of a heat transfer fluid (e.g., a vapor compression refrigerant). Each circuit typically includes a plurality of serpentine passes between plates 14 and 16, as can be best seen in FIG. 2, which shows one of the circuits. Although some of the tubes 12 are omitted in FIG. 1 for clarity purposes, one skilled in the art will recognize that each hole 18, 20 is penetrated by a straight leg portion 12*b* of one of the tubes 12**.

When coil 10 is used as an evaporator, a distributor tube (not shown) connects the inlet of each circuit (e.g., inlet 26 in FIG. 2) to an inlet header (not shown) and an adaptor tube (not shown) connects the outlet of each circuit (e.g., outlet 28 in FIG. 2) to an outlet header (not shown). In operation, the heat transfer fluid enters coil 10 in liquid form through inlet 26 of each circuit, makes multiple passes through coil 10 in each circuit, is substantially vaporized in coil 10 and exits coil 10 through outlet 28 of each circuit substantially in vapor form, thereby cooling a fluid such as air passing through coil 10 external to tubes 12.

In accordance with one embodiment of the present invention, as can be best seen in FIG. 3, each support plate 14, 16 is cut to define two discrete sections 30 and 32. Each section 30 is generally rectangular, as defined by six cut lines 34, 36, 38, 40, 42 and 44. Six additional cut lines 46, 48, 50, 52, 54 and 56 extend generally at fight angles with respect to cut lines 38, 40 and 42 to define two resilient arms 58 and 60, respectively. Cut lines 46, 48 and 50 define arm 58 and cut lines 52, 54 and 56 define arm 60. Resilient arms 58 and 60 couple each section 30 to the corresponding plate 14, 16. Plates 14 and 16 define respective first and second support members, section 30 of plates 14 and 16 define respective third and fourth support members and sections 32 of plates 14 and 16 define respective fifth and sixth support members. Plates 14 and 16, sections 30 and 32 of plate 14 and sections 30 and 32 of plate 16 cooperate to support the weight of tubes 12 and fins 22.

Each section 32 is defined by three cut lines 62, 64 and 66. Cut lines 64 and 66 extend generally at fight angles from cut line 62, such that cut lines 62, 64 and 66 generally define three sides of a rectangle. Each section 32 is relatively immovable compared with the corresponding section 30. Each section 30 is substantially movable relative to the corresponding plate 14, 16 along two axes by means of resilient arms 58 and 60 (i.e., along an axis parallel to a major surface of the corresponding plate 14, 16 and parallel to the rows of holes 18, 20 and along an axis perpendicular to a major surface of the corresponding plate 14, 16 and parallel to respective longitudinal axes of tubes 12). In order to prevent buckling, arms 58 and 60 are sufficiently rigid along their respective longitudinal axes to substantially inhibit movement of the corresponding section 30 along the respective longitudinal axes of arms 58 and 60. By way of contrast, however, each section 32 is movable relative to the corresponding plate 14, 16 substantially along only one axis (i.e., along an axis perpendicular to the major surface of the corresponding support plate 14, 16 and parallel to respective longitudinal axes of tubes 12).

Each plate 14, 16 has plural stress relief apertures 68, 70, 72, 74, 76, 78, 80, 82, 84 and 86. Cut line 38 of each section 30 terminates at aperture 68 of the corresponding plate 14, 16; cut line 40 of each section 30 extends between apertures 70 and 72 of the corresponding plate 14, 16; and cut line 42 of each section 30 terminates at aperture 74 of the corresponding plate 14, 16. Cut line 46 of each plate 14, 16 extends between apertures 68 and 76 of the corresponding plate 14, 16; cut line 48 of each plate 14, 16 extends from between apertures 68 and 70 to a position between apertures 76 and 78 of the corresponding plate 14, 16; cut line 50 of each plate 14, 16 extends between apertures 70 and 78 of the corresponding plate 14, 16; cut line 52 of each plate 14, 16 extends between apertures 72 and 80 of the corresponding plate 14, 16; cut line 54 of each plate 14, 16 extends from between apertures 72 and 74 to a position between apertures 80 and 82 of the corresponding plate 14, 16; and cut line 56 of each plate 14, 16 extends between apertures 74 and 82 of the corresponding plate 14, 16. Cut line 64 of each section 32 extends from cut line 62 to aperture 84 of the corresponding plate 14, 16 and cut line 66 of each section 32 extends from cut line 62 to aperture 86 of the corresponding plate 14, 16. Cut lines 36 and 44 of each section 30 are interrupted by respective ones of holes 18. Cut lines 64 and 66 of each section 32 are interrupted by respective ones of holes 18.

As can be best seen in FIG. 3, cut line 34 is interrupted by a tab 88. Further, tabs 90 and 92 are located where cut lines 38 and 42 terminate at apertures 68 and 74, respectively. A fourth tab 94 interrupts cut line 62 of each section 32. Tabs 88, 90, 92 and 94 maintain sections 30 and 32 within the plane of the corresponding plate 14, 16 during the assembly of heat exchanger coil 10 and specifically during the process of lacing tubes 12 through respective holes 18, 20, as previously described. However, when tabs 88, 90, 92 and 94 are subjected to substantially greater forces than that encountered during assembly of coil 10, such as for example thermal expansion and contraction forces occurring during normal operation of coil 10, tabs 88, 90, 92 and 94 are prone to breakage, thereby allowing the corresponding section 30, 32 to move with respect to a remaining, relatively fixed portion (indicated generally at 96) of the corresponding plate 14, 16.

The diameter of each first hole 18 is substantially greater than the diameter of each second hole 20 and is also substantially greater than the outside diameter of each tube 12. For example, the diameter of each second hole 20 and the outside diameter of each tube 12 may be about ½ inch, while the diameter of each first hole 18 may be about ¾ inch. As previously mentioned, straight leg portions **12*b* of tubes 12 are laced through respective ones of the holes 18, 20. Certain ones of tubes 12 are laced only through first holes 18, while all of the other tubes 12 are laced only through second holes 20. Because first holes 18 have a substantially greater diameter than the outside diameter of tubes 12, those tubes 12 that are laced through first holes 18 do not contact either one of plates 14 and 16, so that the tubes 12 are movable within first holes 18. However, those tubes 12 which are laced through second holes 20 are in contact with both plates 14 and 16 because second holes 20 are sized to have a diameter substantially the same as or only slightly larger than the outside diameter of tubes 12, to allow tubes 12 to be laced through second holes 20, but to remain in contact with respective portions of plates 14 and 16 circumscribing holes 20. Therefore, the tubes 12 which are laced through second holes 20 support the weight of all of the tubes 12 and fins 22**.

All of the tube receiving holes outside of sections 30 and 32 are first holes 18. Within each section 30 and 32, there are both first holes 18 and second holes 20, as can be best seen in FIGS. 1 and 3. In the embodiment illustrated in FIGS. 1–3, all of the second holes 20 are within the middle two rows of holes in each plate 14, 16. However, in practice second holes 20 need not be confined to the middle two rows, but may be randomly located within sections 30 and 32.

In operation, temperature changes cause fins 22 to expand and contract, thereby moving tubes 12 relative to plates 14 and 16. The oversized first holes 18 allow the tubes 12 penetrating therethrough freedom of movement relative to plates 14 and 16 and flexible sections 30 and 32 of each plate 14, 16 allow the tubes 12 penetrating through second holes 20 to move in response to the thermal expansion and contraction of fins 22. Sections 30 and 32 therefore provide flexible support for tubes 12 and fins 22.

Although flexible sections 32 provide some freedom of movement along the respective longitudinal axes of tubes 12, each section 32 is relatively immovable in other directions. However, by concentrating second holes 20 within a relatively small area of each flexible section 30, 32, the effects of thermal expansion and contraction are substantially reduced. In fact, the number of second holes 20 is preferably limited to only those needed for supporting the weight of tubes 12 and fins 22.

The length of each resilient arm 58, 60 along its longitudinal axis and the width thereof along an axis transverse to the corresponding longitudinal axis are selected to provide arms 58 and 60 with sufficient resiliency to accommodate movement of tubes 12 caused by thermal expansion and contraction of fins 22, but not impose additional load on tubes 12. Further, arms 58 and 60 should have sufficient strength to prevent their buckling and to support the weight of the coil bearing on the tubes 12 extending through sections 30. Apertures 68, 70, 72, 74, 76, 78, 80 and 82 reduce the concentration of stresses on arms 58 and 60, thereby providing stress relief. Similarly, apertures 84 and 86 provide stress relief for each section 32.

When coil 10 is positioned vertically (i.e., each section 30 is above the corresponding section 32), as shown in FIGS. 1–3, most of the weight of coil 10 is borne by the tubes 12 extending through second holes 20 in sections 32. When coil 10 is positioned horizontally (i.e., rotated 90° from the vertical position), the weight of coil 10 is more equally distributed among the tubes 12 extending through sections 30 and the tubes 12 extending through sections 32.

Although in the embodiment described hereinabove, two flexible sections 30 and 32 are shown on each support plate 14, 16, each plate 14, 16 may be equipped with only one flexible section (i.e., either section 30 or section 32), particularly in the case of relatively small heat exchanger coils.

Figure 4:
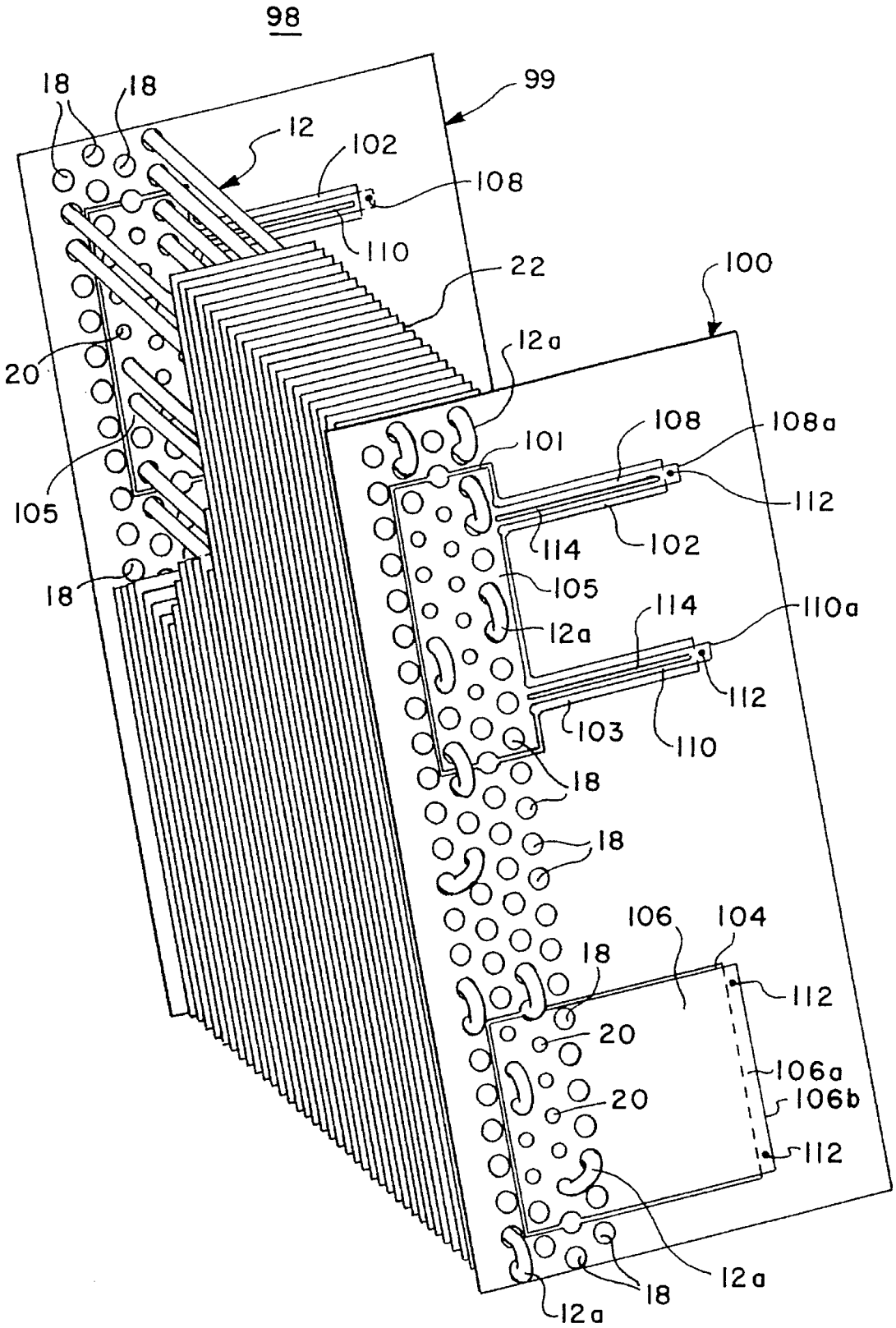
FIG. 4 is a perspective view of an alternate embodiment of a heat exchanger with flexible tube support, according to the present invention.
Figure 5:
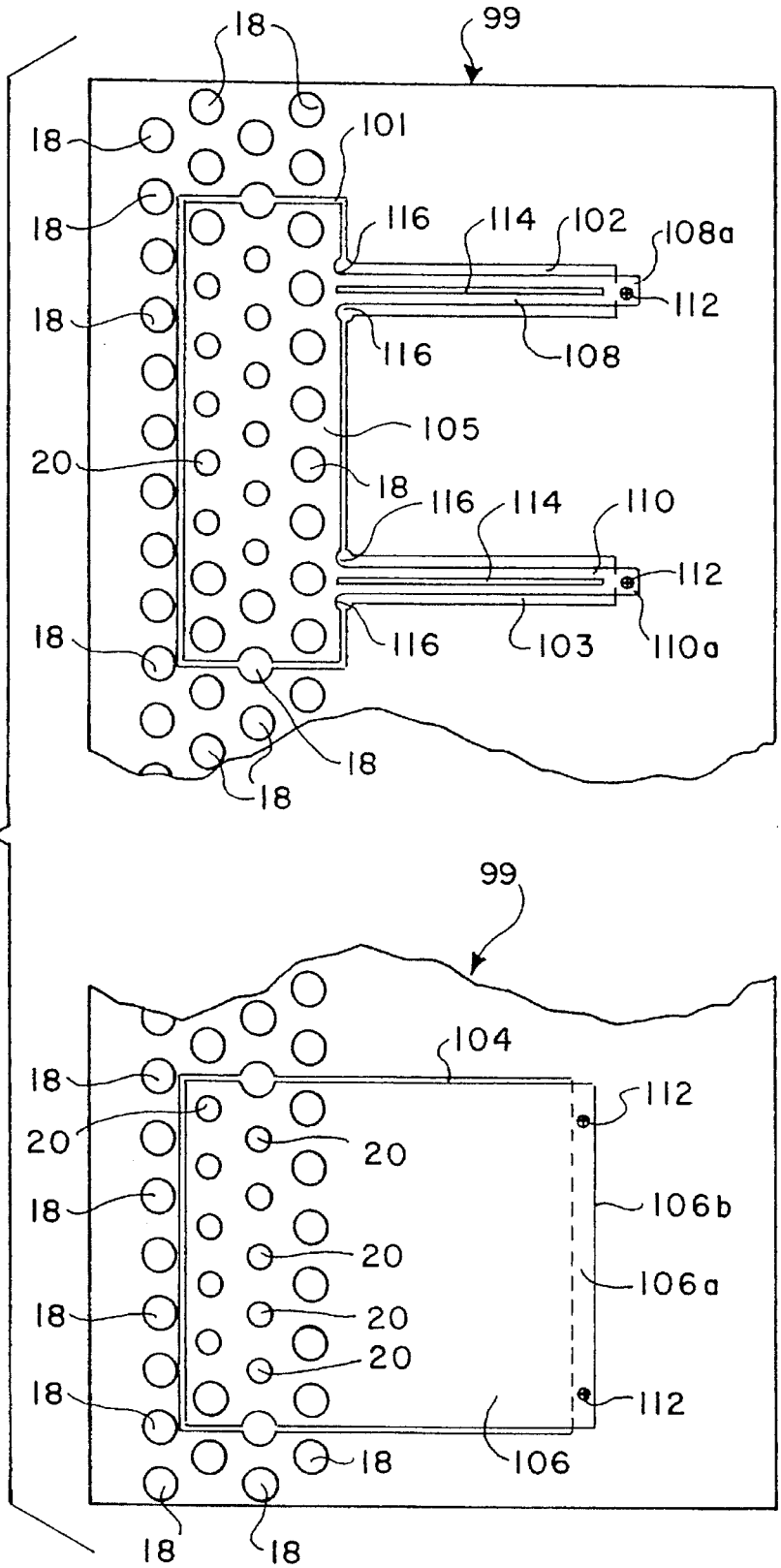
FIG. 5 is a detailed view of a flexible tube support of the heat exchanger of FIG. 4.

Referring to FIGS. 4 and 5, an alternate embodiment of the invention is depicted. Heat exchanger coil 98 is substantially the same as heat exchanger coil 10, described hereinabove with reference to FIGS. 1–3, except that coil 98 has spaced apart, parallel support plates 99 and 100, each of which has four rectangular openings 101, 102, 103 and 104, in addition to plural first holes 18 and plural second holes 20. Plates 99 and 100 define respective first and second support members of coil 98. Rectangular third and fourth support members 105 and 106 are coupled to each plate 99, 100. Elongated arms 108 and 110 extend generally at right angles from each support member 105. Respective portions 108*a* and 110*a* of arms 108 and 110 extend beyond respective openings 102 and 103 and two attachment members 112 (preferably screws) penetrate through portions 108*a* and 110*a* to couple arms 108 and 110 to the respective plates 99 and 100 proximate to respective distal ends of arms 108 and 110, whereby support members 105 are coupled to respective plates 99 and 100. Each arm 108, 110 has a longitudinally extending slot 114 to enhance the resiliency of the corresponding arm 108, 110.

Each support member 105 is aligned with opening 101 of the corresponding plate 99, 100 and the corresponding arms 108 and 110 are aligned with respective openings 102 and 103 of the corresponding plate 99, 100. The resiliency of arms 108 and 110 allows each support member 105 to move relative to the corresponding plate 99, 100 along two axes (i.e., along an axis parallel to a major surface of the corresponding plate 99, 100 and parallel to the rows of holes 18, 20 and along an axis perpendicular to a major surface of the corresponding plate 99, 100 and parallel to respective longitudinal axes of tubes 12).

Each support member 106 is aligned with opening 104 of the corresponding plate 99, 100. A portion 106*a* of each support member 106 extends beyond the corresponding opening 104 and two attachment members 112 penetrate through each portion 106*a* to couple each support member 106 to the corresponding plate 99, 100 proximate to a side edge 106*b* of the corresponding support member 106. By coupling each support member to the corresponding plate 99, 100 proximate to only one side edge (side edge 106*b*) of each support member 106 is resilient enough to allow a major portion of each support member 106 to move relative to the corresponding plate 99, 100 along an axis perpendicular to a major surface of the corresponding support plate 99, 100 and parallel to respective longitudinal axes of tubes 12. Each support member 106 is substantially immovable along an axis parallel to a major surface of the corresponding plate 99, 100. Plates 99 and 100 define respective first and second support members, rectangular member 105 define respective third and fourth support members and rectangular members 106 define respective fifth and sixth support members of coil 98. Plates 99 and 100, the two support members 105 and the two support members 106 cooperates to support the weight of tubes 12 and fins 22.

As in coil 10, described hereinabove with reference to FIGS. 1–3, those tubes 12 that are laced through holes 20 in support members 105 and 106 support the weight of all of the tubes 12 and fins 22. Since all of the second holes 20 are in either a support member 105 or a support member 106, support members 105 and support members 106 support the weight of all of the tubes 12 and fins 22. Support members 105 and 106 are in turn supported by plates 99 and 100. As can be best seen in FIG. 5, each support member 105 is contoured, as indicated at 116, for stress relief. In an alternate embodiment, openings 102 and 103 may be eliminated. Further, in lieu of openings 101 and 104, plates 99 and 100 may have individual tube holes 18 substantially in alignment with respective holes 18, 20 in support members 105 and 106 to accommodate passage of tubes 12 therethrough.

Figure 6:
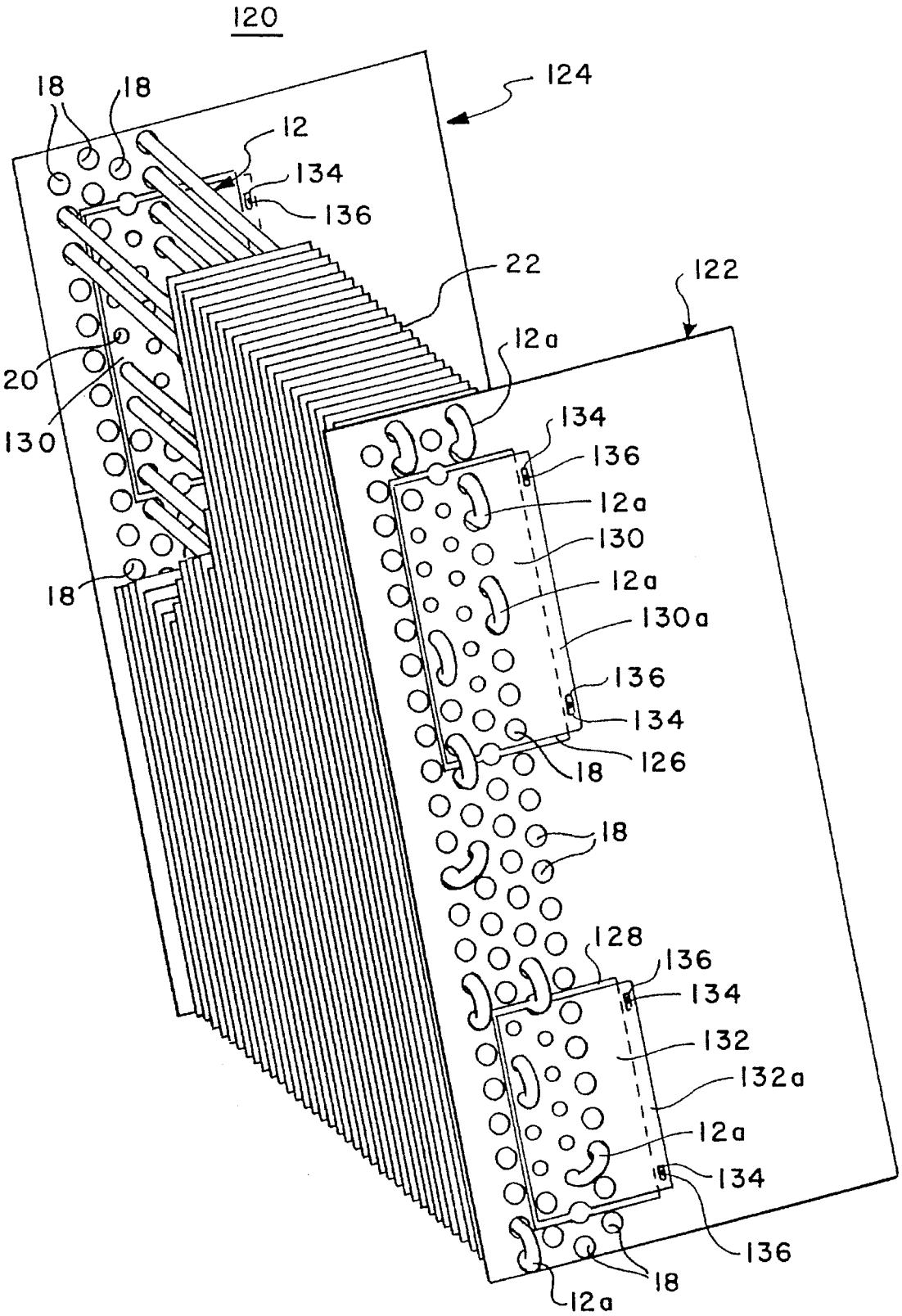
FIG. 6 is a perspective view of another alternate embodiment of a heat exchanger with flexible tube support, according to the present invention.
Figure 7:
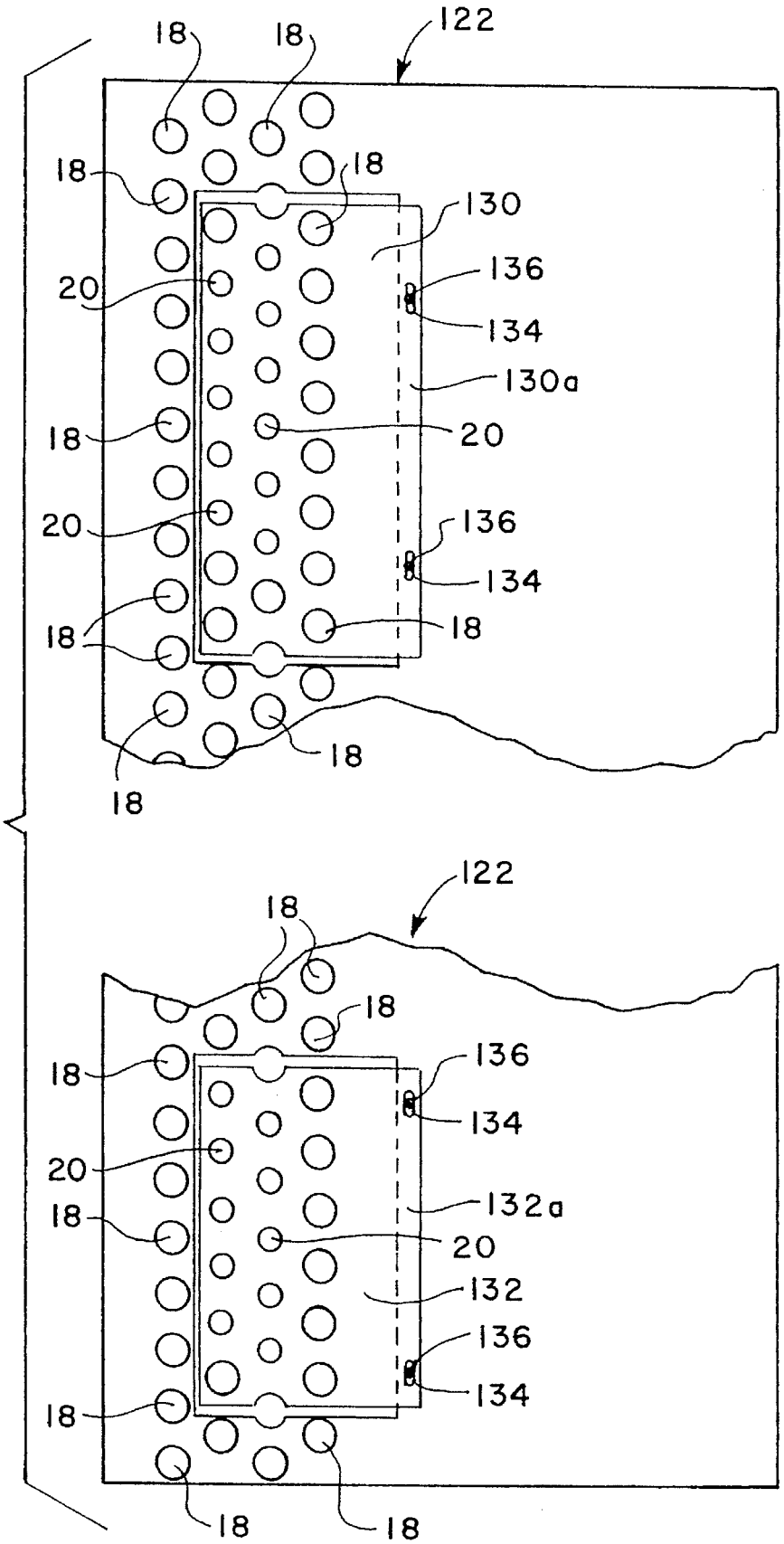
FIG. 7 is a detailed view of a flexible tube support of the heat exchanger of FIG. 6.

Referring to FIGS. 6 and 7, another alternate embodiment of the present invention is depicted. Heat exchanger coil 120 is substantially the same as heat exchanger coil 98, described hereinabove with reference to FIGS. 4 and 5, except that coil 120 has spaced apart, parallel support plates 122 and 124, each of which has two rectangular openings 126 and 128, in addition to plural first holes 18 and plural second holes 20. Rectangular support members 130 and 132 are coupled to each plate 122, 124 in alignment with respective openings 126 and 128. Respective portions 130*a* and 132*a* of support members 130 and 132 extend beyond the corresponding openings 126 and 128. Each portion 130*a*, 132*a* has two generally elliptical slots 134. An attachment member 136 (e.g., a shoulder screw) extends through each slot 134 and penetrates the corresponding plate 122, 124 to attach the corresponding support member 130, 132 to the corresponding plate 122, 124. Each attachment member 136 preferably includes a threaded shaft portion which penetrates into and through the corresponding plate 122, 124, a non-threaded shaft portion, a shoulder between the threaded shaft portion and the non-threaded shaft portion to prevent the non-threaded shaft portion from penetrating through the corresponding plate 122, 124, and a head to retain the corresponding attachment member 136 within the corresponding slot 134. Support members 130 and 132 are therefore able to move relative to the corresponding plates 122, 124 along two axes (i.e., along an axis parallel to a major surface of the corresponding plate 122, 124 and parallel to the rows of holes 18, 20, as limited by the length of the slots 134, and along an axis perpendicular to a major surface of the corresponding plate 122,124 and parallel to respective longitudinal axes of tubes 12, as limited by the length of the non-threaded shaft portion of each attachment member 136 between the shoulder and head thereof). Plates 122 and 124 define respective first and second support members, rectangular members 130 define respective third and fourth support members and rectangular members 132 define respective fifth and sixth support members of coil 120.

As in coil 10 and coil 98, described hereinabove, those tubes 12 which are laced through second holes 20 support the weight of all the tubes 12 and fins 22. Since all of the second holes 20 are in either a first support member 130 or a support member 132, first support members 130 and support members 132 support the weight of all the tubes 12 and fins 22. The weight of support members 130 and 132 are in turn support by plates 122 and 124.

In an alternate embodiment, in lieu of openings 126 and 128, plates 122 and 124 may have individual tube holes 18 substantially aligned with respective holes 18, 20 in support members 130 and 132, to accommodate passage of tubes 12 therethrough.

In another alternate embodiment, support members 130 and 132 may be attached to plates 122 and 124 such that portions 130*a* and 132*a* are not substantially movable along an axis perpendicular to the major surfaces of plates 122 and 124. However, by attaching support members 130 and 132 to plates 122 and 124 proximate to respective side edges 130*b* and 132*b* of support members 130 and 132, the major portions of support members 130 and 132 are sufficiently resilient to be movable along an axis perpendicular to respective major surfaces of plates 122 and 124 and parallel to respective longitudinal axes of tubes 12.

Although various embodiments of the invention have been described hereinabove with reference to a heat exchanger coil having hairpin tubes, the present invention also has utility in heat exchanger coils having straight tubes with each tube terminating at opposed ends thereof in a header.

The best mode for carrying out the invention has now been described in detail. Since changes in and additions to the above-described best mode may be made without departing from the nature, spirit or scope of the invention, the invention is not to be limited to said details, but only by the appended claims and their equivalents.

I claim:

1. A heat exchanger, comprising:

first and second tubes interconnected to accommodate passage of a heat transfer fluid therethrough;

spaced apart first and second support members having respective first and second holes therein, said first tube extending between said first and second support members and penetrating through said first and second holes; and third and fourth support members coupled with the first and second support members, respectively, such that said third and fourth support members are movable relative to the respective first and second support members, said third and fourth support members having respective third and fourth holes therein, said second tube extending between said third and fourth support members and penetrating through said third and fourth holes, said first and second holes being sized to allow said first tube to move relative to said first and second support members, said third and fourth holes being sized to substantially inhibit movement of said second tube relative to said third and fourth support members and to maintain said second tube substantially in contact with said third and fourth support members, whereby said first and second tubes are supported, said second tube being movable with said third and fourth support members relative to said first and second support members.

2. The heat exchanger of claim 1 wherein said tubes have a generally circular cross-section and said first, second, third and fourth holes are generally circular, said first and second holes having a substantially greater diameter than an outside diameter of said first tube such that said first tube is free to move within and relative to said first and second holes and is not maintained in contact with either of said first and second support members, both said first and second tubes being supported by said third and fourth support members.

3. The heat exchanger of claim 2 wherein said third and fourth holes have a diameter only slightly greater than an outside diameter of said second tube to allow said second tube to penetrate through said third and fourth holes and to maintain said second tube substantially in contact with respective portions of said third and fourth support members circumscribing said third and fourth holes.

4. The heat exchanger of claim 1 wherein said third support member is comprised of a flexible section of said first support member and is defined by a plurality of cut lines in said first support member, said fourth support member being comprised of a flexible section of said second support member and being defined by a plurality of cut lines in said second support member.

5. The heat exchanger of claim 4 wherein said flexible sections are generally rectangular.

6. The heat exchanger of claim 4 wherein said first support member has additional cut lines extending generally at right angles from said flexible section of said first support member to define a first resilient arm for supporting said flexible section of said first support member and for accommodating movement of said flexible section of said first support member relative to a remaining portion of said first support member, said second support member also having additional cut lines extending generally at right angles from said flexible section of said second support member to define a second resilient arm for supporting said flexible section of said second support member and for accommodating movement of said flexible section of said second support member relative to a remaining portion of said second support member.

7. The heat exchanger of claim 1 further including a third tube interconnected with said first and second tubes and fifth and sixth support members coupled with the respective first and second support members such that said fifth and sixth support members are movable relative to the respective first and second support members, said fifth and sixth support members having respective fifth and sixth holes therein, said third tube extending between said fifth and sixth support members and penetrating through said fifth and sixth holes, said fifth and sixth holes being sized to substantially inhibit movement of said third tube relative to said fifth and sixth support members and to maintain said third tube substantially in contact with said fifth and sixth support members, said third tube being movable with said fifth and sixth support members relative to said first and second support members.

8. The heat exchanger of claim 7 wherein said third support member is comprised of a first section of said first support member and is defined by a plurality of first cut lines in said first support member, said fourth support member being comprised of a first section of said second support member and being defined by a plurality of first cut lines in said second support member, said fifth support member being comprised of a second section of said first support member and being defined by a plurality of second cut lines in said first support member, said sixth support member being comprised of a second section of said second support member and being defined by a plurality of second cut lines in said second support member.

9. The heat exchanger of claim 8 whereby said first sections are generally rectangular and said second sections are each defined by three cut lines interconnected to form three sides of a rectangle.

10. The heat exchanger of claim 7 wherein said first and second support members are relatively flat first and second plates, respectively, said third and fourth support members being adapted to accommodate movement of said second tube along a longitudinal axis thereof and along an axis parallel to respective planes defined by said first and second plates, said fifth and sixth support members being adapted to accommodate movement of said third tube along a longitudinal axis thereof.

11. The heat exchanger of claim 1 wherein said third support member has a generally rectangular section and a mounting arm extending generally at a right angle from the rectangular section of said third support member and said fourth support member has a generally rectangular section and a mounting arm extending generally at a right angle from the rectangular section of said fourth support member, said mounting arm of said third support member being coupled to said first support member such that said third support member is movable relative to said first support member, said mounting arm of said fourth support member being coupled to said second support member such that said fourth support member is movable relative to said second support member, said third and fourth holes being formed in the generally rectangular sections of said third and fourth support members, respectively.

12. The heat exchanger of claim 11 wherein said third support member has two elongated mounting arms extending generally at right angles from the rectangular section of said third support member and said fourth support member has two elongated mounting arms extending generally at right angles from the rectangular section of said fourth support member, said first support member having a generally rectangular opening and two elongated openings extending generally at right angles from the generally rectangular opening of said first support member, said second support member having a generally rectangular opening and two elongated openings extending generally at right angles from the generally rectangular opening of said second support member, the generally rectangular section of said third support member being aligned with the generally rectangular opening in said first support member and the two elongated mounting arms of said third support member being aligned with the two elongated openings in said first support member such that the generally rectangular section and mounting arms of said third support member are movable within and relative to the two elongated openings in said first support member, the generally rectangular section of said fourth support member being aligned with the generally rectangular opening in said second support member and the two elongated mounting arms of said fourth support member being aligned with the two elongated openings in said second support member such that the generally rectangular section and arms of said fourth support member are movable within and relative to the two elongated openings in said second support member.

13. The heat exchanger of claim 12 further including a third tube interconnected with said first and second tubes and generally rectangular fifth and sixth support members coupled to the respective first and second support members such that said fifth and sixth support members are movable relative to the respective first and second support members, each of said first and second support members having a generally rectangular fourth opening, said fifth support member being aligned with the fourth opening in said first support member such that said fifth support member is movable within and relative to the fourth opening in said first support member, said sixth support member being aligned with the fourth opening in said second support member such that said sixth support member is movable within and relative to the fourth opening in said second support member, said fifth and sixth support members having respective fifth and sixth holes therein, said third tube extending between said fifth and sixth support members and penetrating through said fifth and sixth holes, said fifth and sixth holes being sized to substantially inhibit movement of said third tube relative to said fifth and sixth support members and to maintain said third tube substantially in contact with said fifth and sixth support members, said third tube being movable with said fifth and sixth support members relative to said first and second support members.

14. The heat exchanger of claim 1 wherein said third and fourth support members have respective elongated first and second slots, said heat exchanger further including a first attachment member extending through said first slot and penetrating into said first support member, whereby said third support member is coupled to said first support member and said third support member is movable relative to said first support member along a longitudinal axis of said first slot, said heat exchanger further including a second attachment member extending through said second slot and penetrating into said second support member, whereby said fourth support member is coupled to said second support member and said fourth support member is movable relative to said second support member along a longitudinal axis of said second slot.

15. The heat exchanger of claim 14 wherein each of said first and second support members has a generally rectangular first opening, said third support member being generally rectangular and being aligned with the first opening in said first support member, a first portion of said third support member in which said first slot is formed overlapping the first opening in said first support member, said fourth support member being generally rectangular and being aligned with the first opening in said second support member, a first portion of said fourth support member containing said second slot overlapping the first opening in said second support, at least a second portion of said third support member being movable within and relative to the first opening in said first support member and at least a second portion of said fourth support member being movable within and relative to the first opening in said second support member.

16. The heat exchanger of claim 15 further including a third tube interconnected with said first and second tubes and generally rectangular fifth and sixth support members coupled to the respective first and second support members such that said fifth and sixth support members are movable relative to the respective first and second support members, each of said first and second support members further having a generally rectangular second opening, said third and fifth support members being aligned with respective first and second openings in said first support member such that said third support member is movable within and relative to the first opening in said first support member and the fifth support member is movable within and relative to the second opening in said first support member, said fourth and sixth support members being aligned with respective first and second openings in said second support member such that said fourth support member is movable within and relative to the first opening in said second support member and the sixth support member is movable within and relative to the second opening in said second support member, said fifth and sixth support members having respective fifth and sixth holes therein, said third tube extending between said fifth and sixth support members and penetrating through said fifth and sixth holes, said fifth and sixth holes being sized to substantially inhibit movement of said third tube relative to said fifth and sixth support members and to maintain said third tube substantially in contact with said fifth and sixth support members, said third tube being movable with said fifth and sixth support members relative to said first and second support members.

17. A heat exchanger, comprising:

first and second tubes interconnected to accommodate passage of a heat transfer fluid therethrough;

spaced apart first and second support plates having respective first and second relatively fixed sections and respective first and second flexible sections for supporting said first and second tubes, said first and second flexible sections being movable relative to the respective first and second relatively fixed sections, said first and second relatively fixed sections having respective first and second holes therein and said first and second flexible sections having respective third and fourth holes therein, said first tube extending between said first and second plates and penetrating through said first and second holes, said second tube extending between said first and second plates and penetrating through said third and fourth holes, said first and second holes being sized to allow said first tube to move relative to both said first and second relatively fixed sections, said third and fourth holes being sized to substantially inhibit movement of said second tube relative to said first and second flexible sections and to maintain said second tube substantially in contact with said first and second flexible sections, whereby said first and second tubes are supported by said first and second flexible sections, said second tube being movable with said first and second flexible sections relative to said first and second relatively fixed sections.

18. The heat exchanger of claim 17 further including a third tube interconnected with said first and second tubes, said first and second flexible sections having respective fifth and sixth holes, said third tube extending between said first and second flexible sections and penetrating through said fifth and sixth holes, said fifth and sixth holes being sized to allow said third tube to move relative to both said first and second flexible sections.

19. The heat exchanger of claim 17 wherein said first and second tubes have a generally circular cross-section and said first, second, third and fourth holes are generally circular, said first and second holes having a substantially greater diameter than an outside diameter of said first tube such that said first tube is free to move within and relative to said first and second holes and is not constrained to contact either of said first and second plates, said first and second tubes being supported by said first and second flexible sections.

20. The heat exchanger of claim 19 wherein said third and fourth holes have a diameter only slightly greater than an outside diameter of said second tube to allow said second tube to penetrate through said third and fourth holes and to maintain said second tube substantially in contact with respective portions of said first and second flexible sections circumscribing said third and fourth holes.

21. The heat exchanger of claim 17 wherein said first flexible section is defined by a plurality of cut lines in said first plate and said second flexible section is defined by a plurality of cut lines in said second plate.

22. The heat exchanger of claim 21 wherein said first and second flexible sections are generally rectangular.

23. The heat exchanger of claim 21 wherein said first plate has additional cut lines extending generally at right angles from said first flexible section to define a first resilient arm for supporting said first flexible section and for accommodating movement of said first flexible section relative to said first relatively fixed section, said second plate also having additional cut lines extending generally at right angles from said second flexible section to define a second resilient arm for supporting said second flexible section and for accommodating movement of said second flexible section relative to said second relatively fixed section.

24. The heat exchanger of claim 17 further including a third tube interconnected with said first and second tubes, said first and second plates further including respective third and fourth flexible sections which are movable relative to the respective first and second plates, said third and fourth flexible sections having respective fifth and sixth holes therein, said third tube extending between said third and fourth flexible sections and penetrating through said fifth and sixth holes, said fifth and sixth holes being sized to substantially inhibit movement of said third tube relative to said third and fourth flexible sections and to maintain said third tube substantially in contact with said third and fourth flexible sections, said third tube being movable with said third and fourth flexible sections relative to said first and second plates, said third and fourth flexible sections being cooperative with said first and second flexible sections to support said first, second and third tubes and to accommodate movement of said second and third tubes relative to said first and second plates.

25. The heat exchanger of claim 24 wherein said first and second flexible sections are adapted to accommodate movement of said second tube along a longitudinal axis thereof and along an axis parallel to respective planes defined by said first and second plates, said third and fourth flexible sections being adapted to accommodate movement of said third tube along a longitudinal axis thereof.

26. The heat exchanger of claim 24 wherein said first flexible section is defined by a plurality of first cut lines in said first plate, said second flexible section is defined by a plurality of first cut lines in said second plate, said third flexible section is defined by a plurality of second cut lines in said first plate and said fourth flexible section is defined by a plurality of second cut lines in said second plate.

27. The heat exchanger of claim 26 wherein said first and second flexible sections are generally rectangular and said third and fourth flexible sections are each defined by three cut lines interconnected to form three sides of a rectangle.

28. A heat exchanger, comprising:

first, second and third tubes interconnected to accommodate passage of a heat transfer fluid therethrough; and spaced apart first and second support plates, said first plate having a first relatively fixed section and first and second flexible sections, said second plate having a second relatively fixed section and third and fourth flexible sections, said first and second flexible sections being movable relative to said first relatively fixed section and said third and fourth flexible sections being movable relative to said second relatively fixed section, said first and second relatively fixed sections having respective first and second holes therein, said first, second, third and fourth flexible sections having respective third, fourth, fifth and sixth holes therein, said first tube extending between said first and second plates and penetrating through the first and second holes, said second tube extending between said first and second plates and penetrating through the third and fourth holes, said third tube extending between said first and second plates and penetrating through the fifth and sixth holes, said first and second holes being sized to allow said first tube to move relative to said first and second relatively fixed sections, said third and fourth holes being sized to substantially inhibit movement of said second tube relative to said first and third flexible sections and to maintain said second tube substantially in contact with said first and third flexible sections, said fifth and sixth holes being sized to substantially inhibit movement of said third tube relative to said second and fourth flexible sections and to maintain said third tube substantially in contact with said second and fourth flexible sections, said first, second, third and fourth flexible sections being cooperative to support said first, second and third tubes, said second tube being movable with said first and third flexible sections relative to said first and second relatively fixed sections and said third tube being movable with said second and fourth flexible sections relative to said first and second relatively fixed sections.

* * * * *